United States Patent [19]

Takano

[11] Patent Number: 4,809,875

[45] Date of Patent: Mar. 7, 1989

[54] ELECTRICAL COMPONENT CONTAINER HAVING IMPROVED HINGE UNIT

[75] Inventor: Etsuo Takano, Aichi, Japan

[73] Assignee: Yazaki Corporation, Tokyo, Japan

[21] Appl. No.: 126,150

[22] Filed: Nov. 30, 1987

[51] Int. Cl.[4] ..... B65D 43/16

[52] U.S. Cl. ..... 220/339; 206/328

[58] Field of Search ..... 174/50; 280/727; 220/339; 206/328, 334

[56] References Cited

U.S. PATENT DOCUMENTS

| | | | |
|---|---|---|---|
| 2,852,054 | 9/1958 | Motley | 220/339 |
| 3,351,270 | 11/1967 | Hohnjec | 220/339 |
| 3,485,416 | 12/1969 | Fohrman | 220/339 |
| 3,542,235 | 10/1968 | Hidding | 220/339 |
| 3,737,067 | 6/1973 | Palson | 220/339 |
| 4,202,464 | 5/1980 | Mohs et al. | 220/339 |
| 4,257,537 | 3/1981 | Uhlig | 220/339 |
| 4,293,079 | 10/1981 | Lytle | 220/339 |
| 4,573,600 | 3/1986 | Dubach | 220/339 |

*Primary Examiner*—Jimmy G. Foster

*Attorney, Agent, or Firm*—Sughrue, Mion, Zinn, Macpeak and Seas

[57] ABSTRACT

A container for an electrical component or the like suitable for mounting in an environment such as inside the engine compartment of a motor vehicle. The container includes a case, a cover and a hinge unit formed integrally with the case and cover. The hinge unit has a hinge conjoining wall extending inwardly and upwardly from an end wall of the case, and a flexible hinge portion connecting a hinge conjoining end portion of the cover and the hinge conjoining wall. An inside surface of the hinge conjoining end portion of the cover rests on the top of the hinge conjoining wall when the cover is in its closed position.

3 Claims, 2 Drawing Sheets

ELECTRICAL COMPONENT CONTAINER HAVING IMPROVED HINGE UNIT

BACKGROUND OF THE INVENTION

The present invention relates to a container for an electrical component or the like providing improved protection for the component. More particularly, the invention relates to a hinge unit for a cover fitted over the open end of a container for an electrical component or the like such as may be used in a motor vehicle.

Electrical components for use on motor vehicles often are mounted inside an electrically insulating case and mounted in a narrow space, such as inside the engine compartment of the vehicle. For a small electrical component such as a fusible link, the component is secured in a mounting case and a cover is fitted over the open end of the case to protect the component from external forces and vibration. For this purpose, the case must itself be electrically insulating and have a sufficient mechanical strength to protect the component inside from external forces and vibration. Such a case may, for example, be made of an elastic hard synthetic resin. The cover is coupled to the case by a bent hinge integrally provided at the edge of the open interior of the case.

An example of such a hinged unit is shown in FIGS. 1 and 2. The hinge unit includes a case a, a cover b for covering the open end of the case, and a thin flat hinge c for coupling the end $b_1$ of the cover and the edge $a_2$ of the end wall $a_1$ of the case to each other. The case, the hinge and the cover are integrally formed of a hard synthetic resin or the like using a process such as injection molding.

When the cover b is closed, the hinge c is bent so that the hinge is located over the open interior of the case, as shown in FIG. 2B. However, since the side edge $b_2$ of the cover b is not supported by the side edge $a_3$ of the case a against an external force $F_1$ acting on the cover, the cover moves into the open interior, as indicated at b', and hence the hinge c is greatly bent, as shown at c'. As a result, the hinge can be fractured. For this reason, it is generally recognized that the cover should be supported not only at the front and rear ends thereof, but also at its right and left (lateral) edges. It has still been desired, however, to provide hinge unit for a case for an electrical component for vehicular use in which it is not necessary to support the cover at both the right and left side edges but which is resistant to external forces.

SUMMARY OF THE INVENTION

The present invention was made to meet this demand and to eliminate the problems discussed above in the conventional hinge unit.

Accordingly, it is an object of the present invention to provide a hinge unit in which a hinge is formed integrally with a case and a cover and which is not easily damaged by external forces.

In the hinge unit provided in accordance with the present invention, the hinge is formed of an elastic resin integrally with the case and the cover for the open end of the case in such a manner that the hinge curves between the end face of the cover and the outside surface of the top portion of the inner wall of the container, and the inside surface of the hinge conjoining the end portion of the cover contacts the top of the inner wall in the closed position.

BRIEF DESCRIPTION OF THE DRAWINGS

FIG. 3A is an enlarged sectional view of the conventional hinge with the cover closed;

DESCRIPTION OF THE PREFERRED EMBODIMENTS

Figure 1:
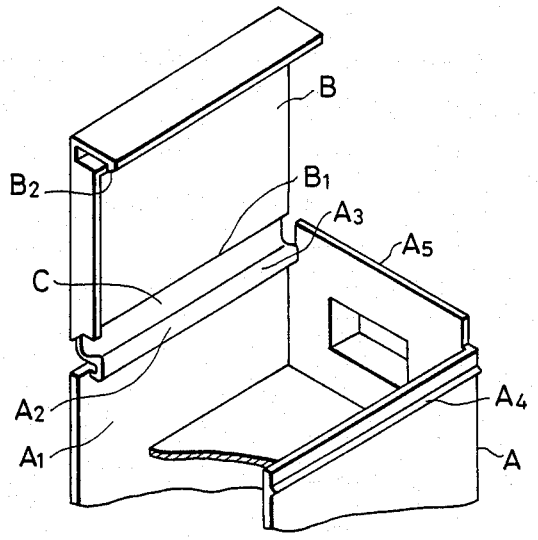
FIG. 1 is a perspective view of a case with a conventional hinge structure.
Figure 2A:
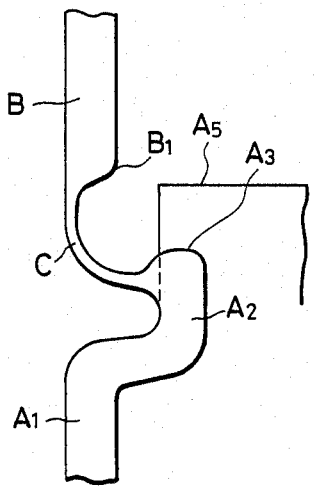
FIG. 2A is an enlarged sectional view of the conventional hinge with the cover opened.
Figure 2B:
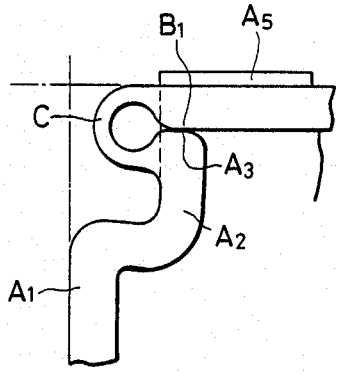
Figure 3:
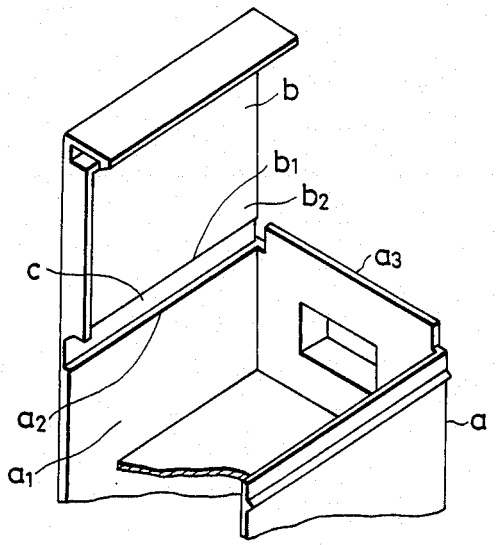
FIG. 3 PRIOR ART
FIG. 3 is a perspective view of a case with a hinge constructed in accordance with the present invention.
Figure 4:
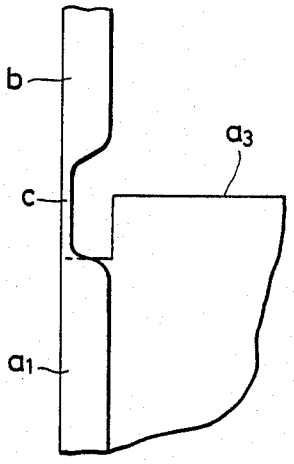
FIG. 4 (a) PRIOR ART
FIG. 4A is an enlarged sectional view of the hinge of FIG. 3 with the cover opened.
FIG. 4B is an enlarged sectional view of the hinge of FIG. 3 with the cover closed.
Figure 4:
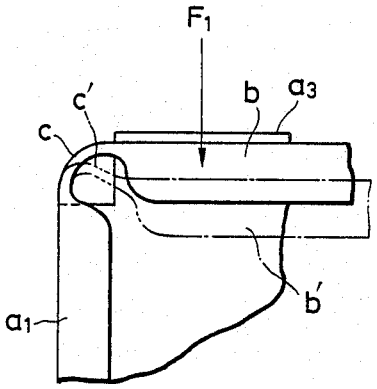
FIG. 4 (b) PRIOR ART

A preferred embodiment of the invention will now be described with reference to FIGS. 3, 4A and 4B of the drawings.

As shown in these drawings, the casing for an electrical component of this preferred embodiment of the present invention includes a case A for housing an electrical component or the like, a cover B, which when closed covers the open end of the case A, and a hinge C for coupling the cover to the case. The hinge C extends straightly along the end of the cover B and does not directly conjoin with an end wall $A_1$ of the case A. A hinge conjoining wall $A_2$ extends inwardly from the end wall A1 along the open interior of the case A so that the hinge C extends from the outside surface of the top portion of the hinge joining with the wall.

When the cover B is closed over the open end of the case A, the hinge C is bent. The distance between the innermost portion of the hinge conjoining wall $A_2$ and the end wall $A_1$ is determined so that the outside surface of the hinge C is located inside that of the end wall when the cover B is closed. The dimensions of the hinge C are chosen so that the top $A_3$ of the hinge conjoining wall $A_2$ contacts the inside surface $B_1$ of the hinge conjoining end portion of the cover B when the cover is closed. In other words, the dimensions of the hinge C are set at appropriate values taking into consideration the thickness of the hinge conjoining wall $A_2$, the conjoined position of the hinge C, the thickness of the cover B, etc.

An engaging projection $A_4$ is provided on the outside surface of the other end wall of the case A so that the projection engages with an engaging projection $B_2$ provided on the end portion of the cover B.

A protective wall $A_5$ is provided to protect the side edge of the cover B when the cover B is in the closed position.

When the cover is closed, the hinge conjoining end portion B1 and the engaging portion $B_2$ of the cover are respectively engaged with the top $A_3$ of the hinge conjoining wall $A_2$ of the case A and the engaging projection $A_4$ of the case. As a result, no excessive stress is caused in the hinge C even if an external force is applied to the hinge.

Since the hinge C is located inside the end wall $A_1$ of the case A, the hinge is protected from damage if the case is struck by an external object.

In the inventive hinge unit wherein the cover is engaged both at its front end portion conjoined to the hinge and at its rear end portion provided with an engaging projection, the hinge is well protected from damage due to external forces applied against the cover when the cover is in the closed position even though the cover is not separately supported at its right and left edges by the container. Therefore, the reliability of the hinge unit is very high, and a case employing a hinge unit of the invention provides excellent protection for the housed electrical component.

It is of course understood that the present invention can be applied as well to a case in which the cover is supported along one of its right and left edges or along both its right and left edges.

What is claimed is:

1. A container for an electrical component comprising: a case having an engaging projection, a cover and a hinge unit formed integrally with said case and said cover, said hinge unit comprising a hinge wall extending inwardly and upwardly from an end wall of said case, and a flexible hinge portion connecting an end portion of said cover and said hinge wall, an inside surface of said end portion of said cover resting on a top of said hinge wall when said cover is in a closed position, wherein said flexible hinge portion extends between an outer edge portion of said top of said hinge wall and an upper edge portion of said end portion of said cover.

2. The container for an electrical component of claim 1, wherein when said cover is in said closed position said flexible portion is disposed internally of extended planes of the rear end wall and the top surface of the cover.

3. The container for an electrical component of claim 1, wherein said cover has an engaging portion engageable with an engaging projection of said case to secure said cover to said case in said closed position.

* * * * *